United States Patent [19]

Young

[11] Patent Number: 4,867,813

[45] Date of Patent: Sep. 19, 1989

[54] SALT-PHASE SENSITIZED WATER-CONTAINING EXPLOSIVES

[75] Inventor: Paul R. Young, Oakmont, Pa.

[73] Assignee: W. R. Grace & Co. - Conn., Lexington, Mass.

[21] Appl. No.: 236,893

[22] Filed: Aug. 26, 1988

[51] Int. Cl.[4] ..... C06B 45/02

[52] U.S. Cl. ..... 149/21; 149/2; 149/47; 149/62; 149/81; 149/90; 149/109.6

[58] Field of Search ..... 149/21, 47, 2, 62, 89, 149/90, 109.6

[56] References Cited

U.S. PATENT DOCUMENTS

| | | | |
|---|---|---|---|
| 2,542,193 | 2/1951 | Hannum | 149/89 |
| 2,692,195 | 10/1954 | Hannum et al. | 149/89 |
| 3,356,544 | 12/1967 | Fee et al. | 149/89 |
| 3,580,754 | 5/1971 | Bernhard | 149/93 |
| 3,765,996 | 10/1973 | Edwards | 149/18 |
| 3,798,092 | 3/1974 | Runge et al. | 149/89 |
| 3,835,782 | 9/1984 | Griffith et al. | 102/27 R |
| 4,058,420 | 11/1977 | Bernhard, IV et al. | 149/2 |
| 4,097,316 | 6/1978 | Mullay | 149/89 |
| 4,273,049 | 6/1981 | Edwards et al. | 149/47 |
| 4,326,900 | 4/1982 | Hattori et al. | 149/89 |
| 4,431,468 | 2/1989 | Edwards et al. | 149/89 |

*Primary Examiner*—Stephen J. Lechert, Jr.

*Attorney, Agent, or Firm*—Bernard, Rothwell & Brown

[57] ABSTRACT

Water-containing explosives, such as emulsions, slurries and water gels, are sensitized in their salt phase with sensitizing energy release agents based on nitroalkanes and nitroalkane blends and optionally including arene coupling agents.

44 Claims, No Drawings

SALT-PHASE SENSITIZED WATER-CONTAINING EXPLOSIVES

BACKGROUND OF THE INVENTION

The present invention relates to improvements to water-containing explosives. More particularly, the invention relates to salt phase sensitization (with nitroalkanes and mixtures of nitroalkanes and arenes) of such explosives to provide highly efficient explosives.

Water-containing explosives, such as emulsions, are based on water-in-oil dispersions having a discontinuous water phase, including oxygen supplying salts dissolved in water, dispersed in a continuous oil phase including light and heavy oils and emulsifying aids and agents. Emulsification under low to high shear process stabilizes the product. The predominant oxygen supplying salt is ammonium nitrate, although sodium nitrate and calcium nitrate, as well as mixtures of these nitrate salts, are frequently used. Other water containing explosives include slurries and water gels. Water gels are characterized by the presence of gums (e.g. galactomannan gums), thickeners, acids and cross-linking agents to provide a stable product. These water containing explosives typically contain in excess of 5% by weight of water and may contain up to about 20% by weight or more of water. Typically about 7 to about 17% by weight is present.

The presence of water reduces the available thermochemical energy provided by the dissolved salts and their fuels. A discrete salt phase (which will not substantially dissolve in the water phase) frequently is blended into an intermediate or final mixture to increase the total available thermochemical energy. This salt phase may also carry entrained air and thus reduce mixture density and add so-called "hot spots" which improve detonation sensitiveness. These salt phase-supplemented water-containing explosives may be known as "heavy ANFO."

ANFO, heavy ANFO, and other water-containing explosives are "non-ideal" explosives. Non-ideal explosives are products whose detonation and explosion state efficacies are relatively dependent upon their exterior "environment," and upon their criticality of diameter and density. By indusrry parlance the "environment" may include: (1) the structural nature of the rock to be blasted, (2) the type and degree of confinement of the product charged into the blast hole, (3) primer strength which will detonate the main charge, (4) blast geometry, shot balance and initiator delay firing pattern, (5) temperatures and humidity during product storage and during shot loading, (6) blast hole waterhead pressure, and (7) the effect of transient pressures from the adjacent firing holes.

"Ideal" explosives, on the other hand, tend to perform independently of their exterior environment. Examples include nitrogelycerin, PETN, RDX and TNT; these are well known high explosives which are frequently labelled as "molecular explosives."

It is well known by those skilled in the art and science of explosives that during the detonation state and explosion state reactions the maximum theoretical energy values of a mixture seldom, if ever, are reached, but may become more fully available when certain enhancing agents have been added to the formulation. Such agents by common parlance have been called sensitizers, energy enhancers, fuel boosters, etc. For purposes of this application these terms are combined into a single phrase to better describe their true function and contribution—Sensitizing Energy Release Agent (SERA).

Currently popular SERAs for example include but are not limited to the following groups: (1) molecular explosives, (2) aluminum granules,flakes and powders, (3) certain energetic chemicals such as, but not limited to, amine nitrates, nitroparaffins and perchlorates, and (4) spherical particles of encapsulated air or other gas. Spherical particles ("microspheres") may be closed or open cell, and range in useful diameters for explosives from about 10 microns to about 350 microns. Generally, a shell midrange of about 40 to 100 microns is preferred. Shell materials of the closed cell microspheres are ceramic, glass or glass-like, phenolic, and polyethylene. Most open cell types are perlites. Particle or liquid displacement densities of the popular varieties vary from 0.03 g/cc for polyethylene to about 0.7 g/cc for aluminum silicates (ceramics). The term "hollow glass microspheres" is frequently applied to the ceramics, the glass-like spheres, and even to perlites.

Until recently, water-containing explosives (WCE) most frequently have been sensitized by (1) incorporating energetic chemicals as part of a host matrix or concentrate, (2) adding from about 0.3% to about 7% by bulk weight of hollow glass microspheres (HGM), or (3) adding about 0.5% to about 30% by weight of aluminum particles. Sometimes both HGM and aluminum are used.

HGM reduces host density from above its critical density to below its critical density. In so doing, HGM also provide or increase the number of "hot spots" necessary in non-ideal explosives for continuation of the detonation wave front. Aluminum particles beneficially add to the heats of detonation and explosion, thus increasing resultant pressures to better fracture and displace the material being blasted.

It is known that superior blasting efficacy can be obtained with blasting agents made of 87–82% comminuted ammonium nitrate prills (AN), fueled and sensitized with 13–17% of 2–3 carbon nitroalkanes. Mixtures of 13% nitropropane/87% AN or 17½% nitroethane/82½% AN are oxygen balanced to near zero. These blasting agents are considerably more energetic than the ANFO compositions they may replace.

Those skilled in the art also know that low viscosity long chain hydrocarbons, e.g., No. 2 diesel fuel (fuel oil or FO), can economically replace the pure fuel contribution of the nitroalkane utilized as described. Nitropropane isoxygen deficient (negative) by 135 gram-atoms per 100 grams whereas fuel oil is generally recognized as negative 346 gram atoms per 100 grams. Thus for considerations of oxygen balance alone each weight percent of fuel oil can replace 2.56 weight percent of nitrogpropane. This trade-off in favor of fuel oil, for reason of economy, is at the expense of otherwise available energy enhancement.

It is known from Edwards et al., U.S. Pat. No. 4,273,049, that a satisfactory bulk blasting agent is achieved with a mixture of about 90% ammonium nitrate, about 7% nitropropane and about 3% fuel oil. This type of bulk blasting agent has no water resistance, however, and must be utilized in dry blast holes or with flexible plastic liners in dewatered blast holes. Also, since it contains no thickening agent it must be mixed and used reasonably promptly before the fuel oil and nitroalkane migrate away from the ammonium nitrate thus reducing sensitiveness.

SUMMARY OF THE INVENTION

It is an object of this invention to provide improved sensitizing energy release agents for non-ideal explosives.

Another object of this invention is to provide nitroalkane and nitroalkane/arene SERAs for water-containing explosives of the emulsion, "heavy ANFO", slurry and water gel types including their respective concentrate, intermediate matrix, and/or salt phases.

It is a further object of this invention to provide methods for appropriately introducing the improved NP-SERA into its respective hosts while maintaining the water resistance and emulsion stability of the product. Other objects and advantages will become apparent to those skilled in the art from the disclosure herein.

This invention advantageously proviees improved non-ideal water-containing explosives through addition of 2 and 3 carbon nitroalkanes, optionally in nitroalkane/arene mixtures, to the concentrate, intermediate, matrix or salt phases of said water-containing explosives.

In one aspect, the present invention relates to a method for preparing a salt-phase sensitized water-containing explosive comprising the steps of sensitizing an inorganic oxidizing salt with nitroalkane and then combining the sensitized salt with a water-in-oil explosive composition.

In another aspect, the present invention relates to a method for preparing a salt-phase sensitized water based explosive comprising the steps of sensitizing an inorganic oxidizing salt with a nitroalkane/arene mixture and then combining the same with a water-in-oil explosive composition.

In another aspect, the present invention relates to sensitizing energy release agents (SERAs) for water based explosives comprising one or more nitroalkanes and, optionally, one or more arenes. These SERAs may be used as the sole SERA or in combination with one or more known SERAs such as aluminum, hollow microspheres, amine nitrate or perchlorate.

DETAILED DESCRIPTION

The sensitizing energy release agents (SERAs) of the present invention are nitroalkanes, especially nitroethane and 1-nitropropane, and mixtures (blends) thereof. Nitroalkanes and blends thereof are purchased from W. R. Grace & Co., Organic Chemicals Division, Lexington, Mass. Nitroethane (NE) and 1-nitropropane (1-NP) are desirable for use as they are relatively safe to handle; unlike molecular explosives they are not shock sensitive. The present SERAs preferably include arene coupling agents which promote intimate contact between the nitroalkane(s) and oil component in the final product. Examples of useful arenes include the mono-, di-, and tri-methyl substituted benzenes in their various spatial orientations. More particularly, these arenes include toluene, xylene, hemimellitine, pseudocumene and mesitylene. Of these, pseudocumene is most preferred. Nitroalkane blends of from about 10 to 90 weight percent NE and about 90 to 10% NP, especially about 30 to 70% NE and about 70 to 30% NP are preferred. Arenes are added in amounts of 3 to 30% by weight of the nitroalkane (or nitroalkane blend). SERAs including nitroalkane(s) and arene(s) are hereinafter referred to as "NP-SERA/ARENE."

The most preferred NP-SERA/ARENE of this invention is a three component mixture of nitroethane, 1-nitropropane and pseudocumene, also available from W. R. Grace & Co. Weight percentages of the three components are varied by those skilled in the art in order to obtain a near-zero oxygen balance (OB) of the final explosive product. The practical range for the OB of the NP-SERA/ARENE varies from about negative 120 gram atoms per 100 grams to about negative 170 gram atoms per 100 grams. This range allows for subsequent mixing with (sensitization of) ammonium nitrate and fuel oil in such proportions that the resultant salt phase can then be added to a finished water-containing explosive product, or an intermediate water phase, which has an OB to as high as negative 15. The addition of NP-SERA and NP-SERA/ARENE in amounts of about 1 to 15 weight percent, especially about 4 to about 11 weight percent, based on the total weight of the explosive composition, is preferred. Use of the inventive SERAs in combination with known sensitizing agents including microspheres, aluminum, amine nitrate and perchlorate is contemplated.

EXAMPLE 1

For comparison or base-line purposes unsensitized water-containing explosive composition of 15–22 weight percent Stable Bulk Emulsion and 85–78 weight percent ANFO are auger-loaded into blast holes. The blasts from these products are qualitatively evaluated by knowledgeable observers and are considered about equal to bulk ANFO results in dry hole blasting.

EXAMPLE 2

A water-containing product of 24.5% weight percent Stable Bulk Emulsion, 75 weight percent ANFO (about 70% AN prills and about 30% fuel oil) and 0.5 weight percent sensitizing hollow microspheres (displacement density=0.15 to 0.18 g/cc) is loaded and blasted as in Example 1, again for comparative purposes. Blasting results are superior to those obtained in Example 1 and are typical of such microsphere-sensitized compositions.

EXAMPLES 3 and 4

Two salt-phase NP-SERA/ARENE sensitized heavy-ANFO compositions of the present invention were produced. A first composition (Example 3) employed 27 weight percent of the Stable Bulk Emulsion of comparative examples 1 and 2 to which was added 0.5 weight perecent microspheres and 65.2 weight percent ammonium nitrate prills which had first been treated (sensitized) with 5.9% of the preferred NP-SERA/ARENE and 1.4 weight percent fuel oil. A second inventive composition (Example 4) employed 40 weight percent Stable Bulk Emulsion, 0.5 weight percent microspheres, 53.5 weight percent AN prills sensitized with 4.8% NP-SERA/ARENE and 1.2% fuel oil. Each of these inventive compositions produced a vastly superior blast. Advantageously, this excellent blast is obtained with only about a 5 percent increase in total cost, and mucking (removal of blasted rocks) time was reduced by 23 percent.

In the following Examples 5 through 12, blasts of prior art heavy-ANFO versus inventive salt-phase sensitized heavy-ANFO compositions in cartridge form were quantitatively compared. All compositions were salt-phase sensitized with a preferred NP-SERA/ARENE of nitroethane, 1-nitropropane and pseudocumene. Continuous rate probes, connected to a Nicolet digital oscilloscope with bubble memory, measured initial and steady rates of detonation (ROD). Industry standard field-produced, unsensitized bulk-grade emulsions varying in age from three to six months were employed. All plain emulsion products failed to blast in 5 inch unconfined diameters when shot with a one pound Pentolite booster. All heavy-ANFO (30% emulsion and 70% ANFO (94.5% AN and 5.5% FO, by weight)) products failed to fully shoot in 3½ inch unconfined diameters when detonated with twelve ounce pentolite boosters.

EXAMPLE 5

Heavy-ANFO (70/30 weight ratio of ANFO emulsion) sensitized with 0.3% hollow glass microspheres of 0.18 g/cc displacement density was loaded into a 2 inch diameter pipe and shot. The steady-state ROD was below about 1200 meters per second (mps).

EXAMPLE 6

The composition of Example 5, but being salt-phase sensitized with 4.2% SERA, produced a steady-state ROD 125% higher than that produced in Example 5.

EXAMPLE 7

A heavy-ANFO product as in Example 5 was loaded into a three inch diameter paper cartridge and shot. The steady-state ROD was about 1800 mps.

EXAMPLE 8

The product of Example 7, but being salt-phase sensitized with 4.2% SERA, produced a steady-state ROD 40% higher than that produced in Example 7.

EXAMPLE 9

Heavy-ANFO (75/25 weight ratio of ANFO/emulsion) sensitized with 0.75 weight percent hollow glass microspheres of 0.7 g/cc density was loaded into a 3½ inch diameter paper cartridge and shot. The steady-state ROD produced was about 2300 mps.

EXAMPLE 10

Example 9 was repeated, but with the heavy-ANFO being salt-phase sensitized with 4.2 weight percent SERA. The steady-state ROD increased 42% versus Example 9.

EXAMPLE 11

A heavy-ANFO which was salt-phase sensitized with 4.2 weight % SERA, and further sensitized with 0.6% of hollow glass microspheres (0.18 g/cc), was loaded into a 3½ inch diameter paper cartridge and shot. The steady-state ROD produced was about 3944 mps.

EXAMPLE 12

The sensitized composition of Example 11 was loaded into a 5 inch diameter paper cartridge and shot. The steady-state ROD produced was about 4966. Examples 11 and 12 illustrate the role that cartridge (and hole) diameter serves in blast production.

EXAMPLE 13

An increase in detonation pressure of salt-phase sensitized heavy-ANFO, versus standard heavy-ANFO, was demonstrated. A field-made heavy-ANFO (35% emulsion/65% ANFO), and a NP-SERA/ARENE salt-phase sensitized counterpart according to the present invention, were loaded into 5 inch unconfined diameters. The NP-SERA/ARENE sensitized product increased steady-state pressures by an average of 35%.

As mentioned throughout this application, water based explosive compositions such as emulsions, slurries and the cross-linked water gels are sensitized in the salt phase according to the present invention. The mere addition of nitroalkanes to water-in-oil emulsions may limit the shelf life of the emulsion and yield a product which is less acceptable to the industry. Treating the salt phase (e.g. whole or comminuted AN prills) with SERA and then adding the sensitized salt phase to the emulsion, slurry or water gel provides a sensitized highly stable explosive product..

Bulk application salt-phase sensitized emulsion products are conveniently produced by combining the SERA with the fuel oil prior to treating the AN prills. Alternatively, the SERA may be added to a previously produced ANFO product whereupon the sensitized ANFO is combined with emulsion. The desirable arene component serves as a coupling agent for the nitroalkane and the fuel oil to ensure complete mixture; 1-NP is fully miscible with NE.

Bulk application salt-phase sensitized water gels are produced in a manner similar to the production of the emulsion-based explosive products. It has been found best to add the cross-linking component, after all other components are fully mixed, by injection as the product is being discharged into the blast hole or loaded into shot hole bags. With slight routine experimentation, however, pumpable water gels can be produced by blending the sensitized salt phase directly into gel concentrate or intermediate.

Cartridge products containing emulsions or gels are produced as above. A preferred cartridge package includes a liner of 5 to 5.5 mil thick tri-extruded polyethylene-nylon-polyethylene, or a co-extruded high molecular weight polyethylene, in order to contain the nitroalkanes which have moderately high vapor pressures.

Although the invention has been described in connection preferred compositions and methods, and in specific Examples, it is not so limited. Variations within the scope of the appended claims will be apparent to those skilled in the art.

I claim:

1. A process for preparing a salt-phase sensitized water-containing explosive composition, comprising:

(a) sensitizing a solid inorganic oxidizing salt with nitroalkane; and (b) combining said sensitized salt with a water-based explosive composition comprising water, an inorganic oxidizing salt dissolved in said water, fuel, and emulsifying agent.

2. A process of claim 1 wherein step (a) comprises mixing salt with nitroalkane in a ratio of between about 87 to 13 and about 82½ to 17½.

3. A process of claim 1 wherein said inorganic oxidizing salt comprises a nitrate salt.

4. A process of claim 3 wherein said nitrate salt comprises ammonium nitrate.

5. A process of claim 1 wherein said inorganic oxidizing salt comprises a mixture of ammonium nitrate and sodium nitrate.

6. A process of claim 1 wherein said nitroalkane comprises nitroethane.

7. A process of claim 1 wherein said nitroalkane comprises 1-nitropropane.

8. A process of claim 1 wherein said nitroalkane comprises a mixture of nitroethane and 1-nitropropane.

9. A process of claim 8 wherein said mixture comprises, by weight, about 10 to 90% nitroethane and about 90 to 10% 1-nitropropane.

10. A process for preparing a salt-phase sensitized water-containing explosive composition, comprising:

(a) preparing a sensitized salt by treating an inorganic oxidizing salt with a sensitizing mixture comprising nitroalkane and arene; and (b) dispersing said sensitized salt in a water-based explosive composition comprising water, inorganic oxidizing salt dissolved in said water, fuel and emulsifying agent.

11. A process of claim 10 wherein said oxidizing salt comprises a nitrate salt.

12. A process of claim 11 wherein said nitrate salt comprises ammonium nitrate.

13. A process of claim 11 wherein said nitrate salt comprises sodium nitrate.

14. A process of claim 10 wherein said oxidizing salt comprises a mixture of ammonium nitrate and sodium nitrate.

15. A process of claim 10 wherein sid oxidizing salt comprises a mixture of salt prills and comminuted salt prills.

16. A process of claim 10 wherein said sensitizing mixture comprises about 70 to 47% by weight of nitroalkane and about 30 to 3 by weight of arene.

17. A process of claim 10 wherein said nitroalkane comprises nitroethane and/or 1-nitropropane and said arene comprises mono-, di-, or tri-methyl substituted benzene.

18. A process of claim 17 wherein said sensitizing mixture comprises nitroalkane and arene in amounts sufficient to provide an oxygen balance of about zero in the water-containing explosive composition.

19. A process of claim 17 wherein said arene comprises pseudocumene.

20. A process of claim 10 wherein said sensitizing mixture further comprises fuel oil.

21. A process of claim 20 wherein said fuel oil comprises no. 2 diesel fuel.

22. A sensitizing energy release agent for water-based explosive compositions comprising nitroalkane and arene.

23. A sensitizing energy release agent of claim 22 wherein said nitroalkane comprises one or more of nitroethane and nitropropane.

24. A sensitizing energy release agent of claim 23 wherein said nitropropane comprises 1-nitropropane.

25. A sensitizing energy release agent of claim 22 wherein said arene comprises one or more of mono-, di-, and tri-methyl substituted benzene.

26. A sensitizing energy release agent of claim 22 wherein said arene comprises one or more of toluene, xylene, hemimellitine, pseudocumene and mesitylene.

27. A sensitizing energy release agent consisting essentially of nitroalkane and arene.

28. A sensitizing energy release agent of claim 27 wherein said nitroalkane is nitroethane.

29. A sensitizing energy release agent of claim 27 wherein said nitroalkane is nitropropane.

30. A sensitizing energy release agent of claim 27 wherein said nitroalkane is a blend of nitroethane and nitropropane.

31. A sensitizing energy release agent of claim 30 wherein said nitropropane is 1-nitropropane.

32. A sensitizing energy release agent of claim 27 wherein said arene is one or more of mono-, di-, and tri-methyl substituted benzene.

33. A sensitizing energy release agent of claim 27 wherein said arene is one or more of toluene, xylene, hemimellitine, pseudocumene and mesitlyene.

34. A sensitizing energy release agent consisting essentially of nitroethane, nitropropane and tri-methyl benzene.

35. A sensitizing energy release agent consisting essentially of nitroethane, 1-nitropropane and pseudocumene.

36. A water-containing explosive composition comprising a mixture of a water-in-oil component and a discreet salt phase component, the salt phase component being sensitized with a sensitizing energy release agent comprising nitroethane, nitropropane or a mixture thereof.

37. A composition of claim 36 wherein said sensitizing energy release agent comprises from about 10 to 90 percent by weight of nitroethane and from about 90 to 10 percent by weight of nitropropane.

38. A composition of claim 36 wherein said sensitizing energy release agent comprises from about 30 to 70 percent by weight of nitroethane and from about 70 to 30 percent by weight of nitropropane.

39. A composition of claim 37 wherein said nitropropane is 1-nitropropane.

40. A composition of claim 38 wherein said nitropropane is 1-nitropropane.

41. A composition of claim 36 wherein said sensitizing energy release agent further comprises an arene.

42. A composition of claim 41 wherein said arene comprises one or more of toluene, xylene, hemimellitine, pseudocumene and mesitylene.

43. A composition of claim 36 wherein said sensitizing energy release agent consists essentially of a mixture of nitroethane, nitropropane and an arene.

44. A composition of claim 43 wherein said arene comprises one or more of toluene, xylene, hemimellitine, pseudocumene and mesitylene.

* * * * *